US007359658B2

(12) United States Patent
Lee et al.

(10) Patent No.: US 7,359,658 B2
(45) Date of Patent: Apr. 15, 2008

(54) TENSION ADJUSTER OF BELT OF IMAGE FORMING APPARATUS

(75) Inventors: Jin-Soo Lee, Suwon-si (KR); Heung-Sup Jeong, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 46 days.

(21) Appl. No.: 11/108,795

(22) Filed: Apr. 19, 2005

(65) Prior Publication Data

US 2005/0254857 A1 Nov. 17, 2005

(30) Foreign Application Priority Data

May 14, 2004 (KR) ..... 10-2004-0034270

(51) Int. Cl.
*G03G 15/00* (2006.01)

(52) U.S. Cl. ..... 399/165

(58) Field of Classification Search ..... 399/165, 399/302, 303, 308, 312
See application file for complete search history.

(56) References Cited

U.S. PATENT DOCUMENTS

| | | | | |
|---|---|---|---|---|
| 4,081,152 | A | 3/1978 | Henderson | |
| 4,364,656 | A * | 12/1982 | Yanagawa | 399/92 |
| 6,249,662 | B1 * | 6/2001 | Lee | 399/165 |
| 6,269,231 | B1 * | 7/2001 | Castelli et al. | 399/165 |
| 6,445,895 | B2 * | 9/2002 | Shirasawa et al. | 399/116 |
| 2005/0002693 | A1 * | 1/2005 | Pak et al. | 399/165 |

FOREIGN PATENT DOCUMENTS

| | | |
|---|---|---|
| JP | 59015971 A * | 1/1984 |
| JP | 59-083186 | 5/1984 |
| JP | 60-186877 | 9/1985 |
| JP | 61-020971 | 1/1986 |
| JP | 04-020441 | 1/1992 |
| JP | 04-051279 | 2/1992 |
| JP | 05-201576 | 8/1993 |
| JP | 07-168474 | 7/1995 |
| JP | 2000-075679 | 3/2000 |
| JP | 2001-022188 | 1/2001 |
| KR | 2000-0010292 | 2/2000 |

OTHER PUBLICATIONS

Computer translation JP2001-022188A.*

* cited by examiner

*Primary Examiner*—Quana Grainger
(74) *Attorney, Agent, or Firm*—Roylance, Abrams, Berdo & Goodman, L.L.P.

(57) ABSTRACT

A tension adjuster for a belt of image forming apparatus is provided. The tension adjuster of the belt includes a tension roller which rotates in contact with an inner surface of the belt. A fixed shaft is disposed a predetermined distance away from the tension roller. A pair of swing arms connect the fixed shaft to a shaft of the tension roller. A tension unit rotates the swing arm on a circumference of the fixed shaft in a first direction so that the tension roller produces a tension on the belt. A tension releasing unit applies torque to the swing arm on the circumference of the fixed shaft in a second direction opposite to the first direction. When the belt rotates, torque generated by the tension unit is greater than the torque generated by the tension releasing unit. When the belt is stopped, the belt is released by the torque of the tension releasing unit.

9 Claims, 5 Drawing Sheets

TENSION ADJUSTER OF BELT OF IMAGE FORMING APPARATUS

BACKGROUND OF THE INVENTION

This application claims the benefit under 35 U.S.C. 119(a) of Korean Patent Application No. 10-2004-0034270, filed on May 14, 2004, the entire disclosure of which is hereby incorporated by reference.

1. Field of the Invention

The present invention relates to a tension adjuster for a belt of an image forming apparatus. More particularly, the present invention relates to a tension adjuster for a belt for printing which produces tension on the belt only when the belt is in operation.

2. Description of the Related Art

In general, an electrophotographic printer such as a laser printer prints an image by forming an electrostatic latent image on a photosensitive medium. The electrophotographic printer develops the electrostatic latent image using a toner having a predetermined color. Then, the electrophotographic printer transfers the developed image to a sheet of print paper.

FIG. 1 illustrates a portion of a conventional image forming apparatus using a photosensitive belt as a photosensitive medium. Referring to FIG. 1, the image forming apparatus includes a photosensitive belt 10 supported by a plurality of rollers 11, 12, 13, and 14. The photosensitive belt 10 circulates along an enclosed path on which a charger 15, a laser scanning unit (LSU) 16, and a developer 17 are disposed.

The charger 15 charges the photosensitive belt 10 to a predetermined potential. The LSU 16 scans light onto a surface of the charged photoreceptor belt 16 to form an electrostatic latent image and the developer 17 develops the electrostatic latent image into a toner image. A transferring roller 20 rotates in contact with the photosensitive belt 10 and transfers the toner image to a printing medium P passing therebetween.

The roller 11 is a driving roller which drives the photosensitive belt 10. Tension roller 14 applies an appropriate tension to the photosensitive belt 10. The rollers 12 and 13 have respective shafts supported at fixed positions. A shaft 14*a* of the tension roller 14 is connected to a shaft 42 by a pair of swing arms 30. The tension roller 14 is supported by the shaft 42 and is disposed a predetermined distance from the shaft 14*a*. The shaft 14*a* is elastically biased in a direction A to produce a tension on the photosensitive belt 10.

FIG. 2 illustrates an enlarged view of the tension adjuster illustrated in FIG. 1. Referring to FIG. 2, the swing arms 30 connect shafts 14*a* and 42. A tension spring 44 and a boss 46 are disposed on the shaft 42 adjacent to one of the swing arms 30. The boss 46 is fixed to the shaft 42. One end of the tension spring 44 is connected to the boss 46. The other end of the tension spring 44 is connected to the swing arm 30 in an elastically biased state. The tension spring 44 forces the swing arms 30 to elastically bias toward the photosensitive belt 10 (in the direction A in FIG. 1). Therefore, the tension roller 14 maintains tension on the photosensitive belt 10.

The conventional tension adjuster produces a tension on the photosensitive belt 10 regardless of whether the photosensitive belt 10 is being used. Therefore, when a printer is not used for a long period of time, the photosensitive belt 10 becomes deformed, thereby degrading print quality.

In Japanese Patent Publication No. 2001-22188, the entire disclosure of which is hereby incorporated by reference, an apparatus is disclosed to prevent the deformation of a photosensitive belt. The apparatus includes a cam and a plurality of gears that transmit the rotation of a driving unit of the photosensitive belt to the cam.

However, the apparatus is relatively complicated since a cam is used. Moreover, a tensile force of the photosensitive belt may change after the photosensitive belt is used for a relatively long period of time.

Accordingly, there is a need for a photosensitive belt for printing having a tension adjuster being capable of effectively maintaining and releasing tension on the photosensitive belt while minimizing size.

SUMMARY OF THE INVENTION

An aspect of the present invention is to solve at least the above problems and/or disadvantages and to provide at least the advantages described below. Accordingly, an aspect of the present invention is to provide a tension adjuster of a photosensitive belt for printing, the tension adjuster being capable of effectively maintaining and releasing tension in the photosensitive belt while taking up a small area for installation.

According to an aspect of the present invention, there is provided a tension adjuster of a belt. The tension adjuster includes a tension roller which rotates in contact with an inner surface of the belt. A fixed shaft is disposed a predetermined distance away from the tension roller. A pair of swing arms connect the fixed shaft to a shaft of the tension roller. A tension unit rotates the swing arm on a circumference of the fixed shaft in a first direction such that the tension roller produces a tension on the belt. A tension releasing unit applies torque to the swing arm on the circumference of the fixed shaft in a second direction opposite to the first direction. When the belt rotates, a torque generated by the tension unit is greater than a torque generated by the tension releasing unit. When the belt is stopped, the belt is released by the torque of the tension releasing unit.

The tension unit includes a friction clutch disposed on the circumference of the fixed shaft on an outward side of the swing arm. A fixed shaft gear is located on the circumference of the fixed shaft so that the friction clutch is disposed between the fixed shaft gear and the swing arm. A rotating unit rotates the fixed shaft gear. The friction clutch includes a friction clutch spring interposed between the fixed shaft gear and the swing arm.

The tension adjuster further includes a slip ring which is disposed between the friction clutch spring and the swing arm. The slip ring is coupled to one end of the friction clutch spring and is separated from the swing arm to transmit a frictional force from the friction clutch spring to the swing arm.

The rotating unit includes a plurality of gear trains interposed between a gear driving the belt and the fixed shaft gear. The rotating unit is a motor driving the fixed shaft gear.

The tension releasing unit may include a tension releasing spring disposed on an opposite side of the tension unit with respect to the swing arm on the circumference of the fixed shaft and is elastically biased to the second direction.

The tension releasing unit may further include a boss fixed to the fixed shaft. The boss is disposed on the circumference of the fixed shaft opposite to the swing arm with respect to the tension releasing spring.

A plurality of grooves are preferably formed in a concentric circle on a side of the boss facing the tension releasing spring. A tensile force of the tension releasing spring may be adjusted by coupling one end of the tension releasing spring to the groove. The tensile force of the tension releasing spring may be adjusted according to where the boss is coupled to the fixed shaft.

The belt may be a photosensitive belt.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
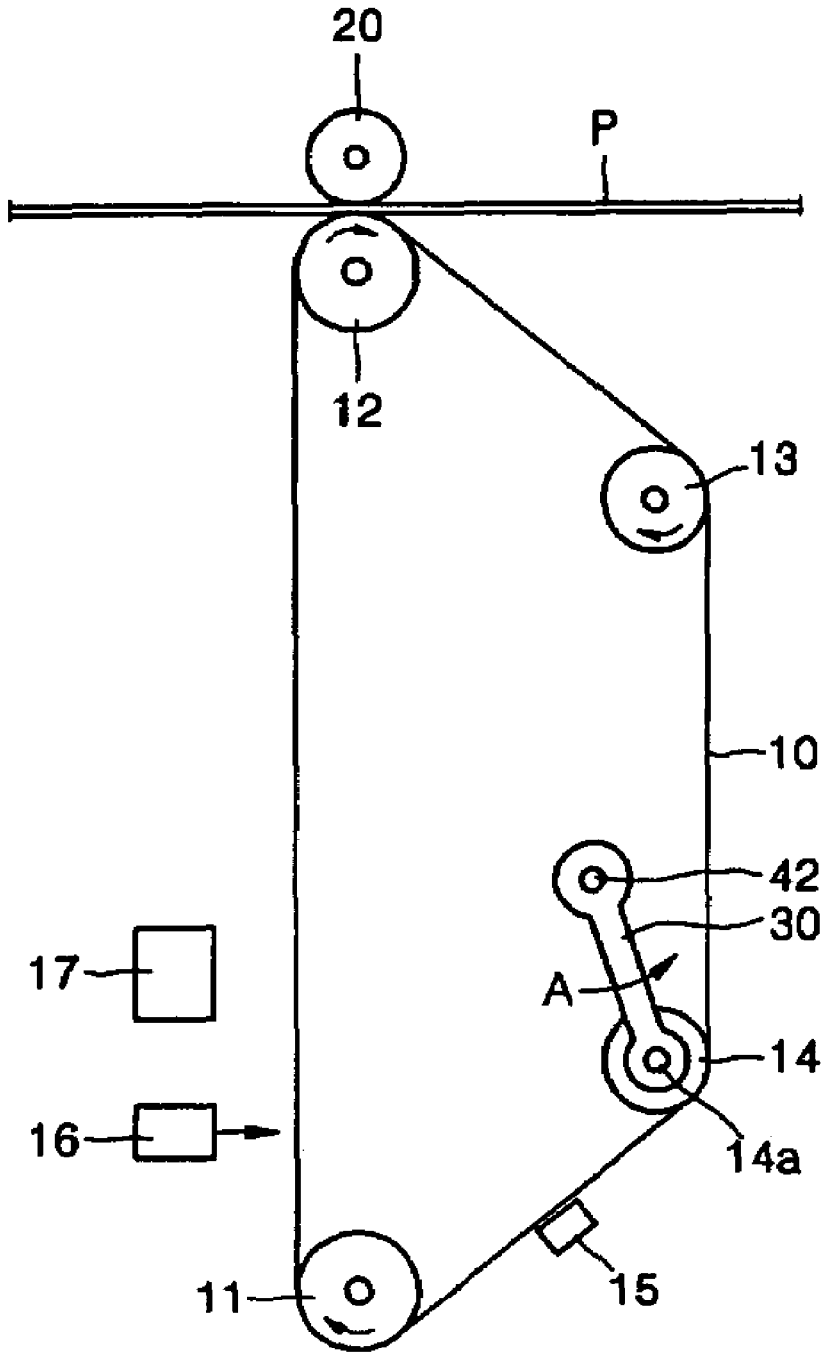
FIG. 1 (PRIOR ART)
FIG. 1 is a schematic view of a printer including a conventional tension adjuster for a belt.
Figure 2:
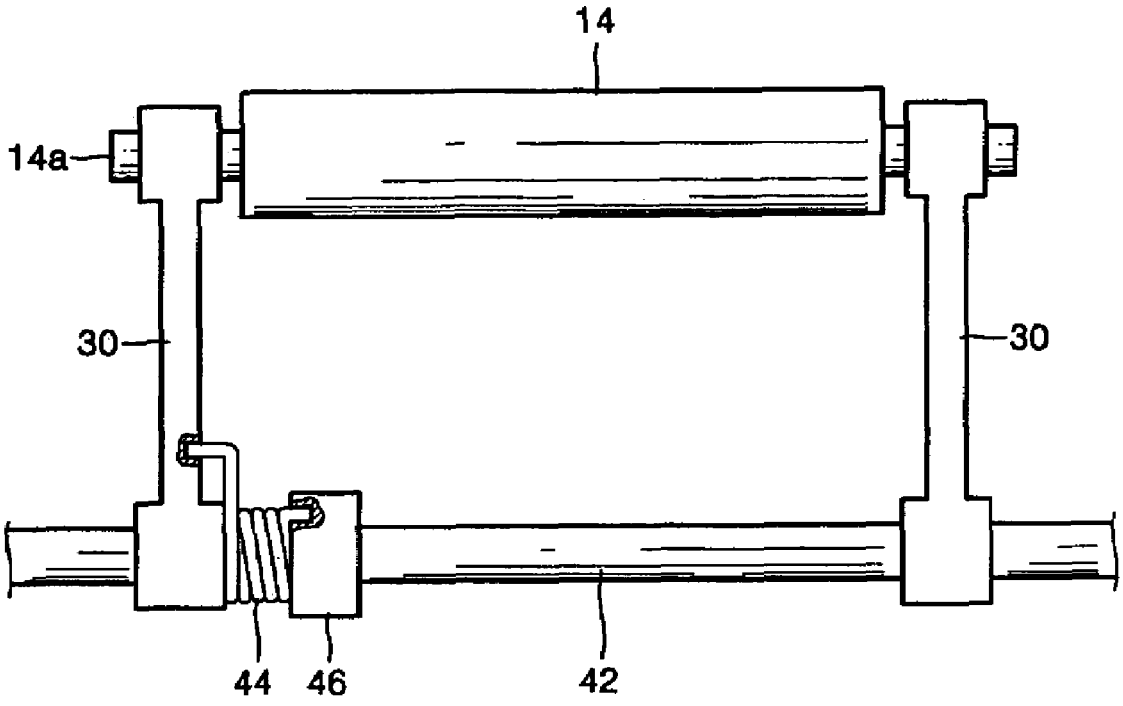
FIG. 2 (PRIOR ART)
FIG. 2 is an enlarged schematic view of the tension adjuster illustrated in FIG. 1.
Figure 3:
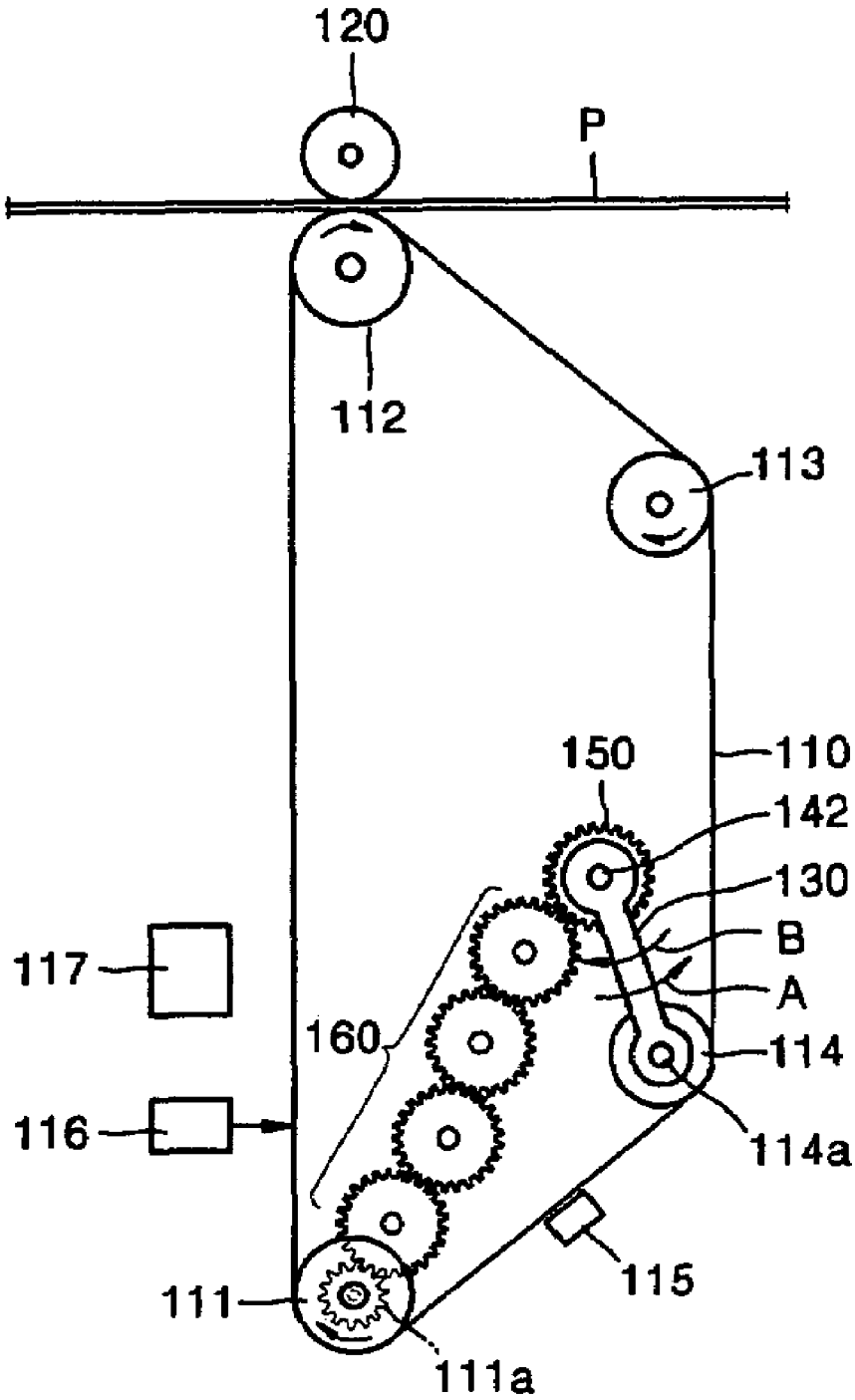
FIG. 3 is a schematic view of a printer including a tension adjuster for a belt for printing in accordance with an embodiment of the present invention.

FIG. 3 is a schematic view of an image forming apparatus including a tension adjuster of a photosensitive belt for printing in accordance with an embodiment of the present invention. Elements that are identical to elements in FIG. 1 are labelled with the same names and their descriptions will be omitted for clarity and conciseness.

Referring to FIG. 3, the image forming apparatus includes a photosensitive belt 110 supported by a plurality of rollers 111, 112, 113, and 114. The photosensitive belt 110 circulates along an enclosed path on which a charger 115, a laser scanning unit (LSU) 116, and a developer 117 are disposed. The charger 115 charges the photosensitive belt 110 to a predetermined potential. The LSU 116 scans light onto a surface of the charged photoreceptor belt 116 to form an electrostatic latent image and the developer 117 develops the electrostatic latent image into a toner image. The toner image is transferred by a transferring roller 120 which rotates in contact with the photosensitive belt 110 to a printing medium P passing therebetween.

The roller 111 is a driving roller which drives the photosensitive belt 110. Tension roller 114 applies an appropriate tension to the photosensitive belt 110. The rollers 112 and 113 have respective shafts supported at predetermined positions. A pair of swing arms 130 connect shaft 114*a* of the tension roller 114 to a fixed shaft 142. The shaft 142 supports the shaft 114*a* and is disposed a predetermined distance from the shaft 114*a*. The shaft 114*a* is elastically biased in a direction A when the driving roller 1111 rotates.

A plurality of gear trains 160 are interposed between a gear 111*a* of the driving roller 111 and a shaft gear 150 disposed on an outer circumferential surface of the shaft 142. The gear trains 160 transfer torque generated by the gear 111*a* of the driving roller 111 to the shaft gear 150. Therefore, the shaft gear 150 is rotated by the driving roller 11*a*.

Figure 4:
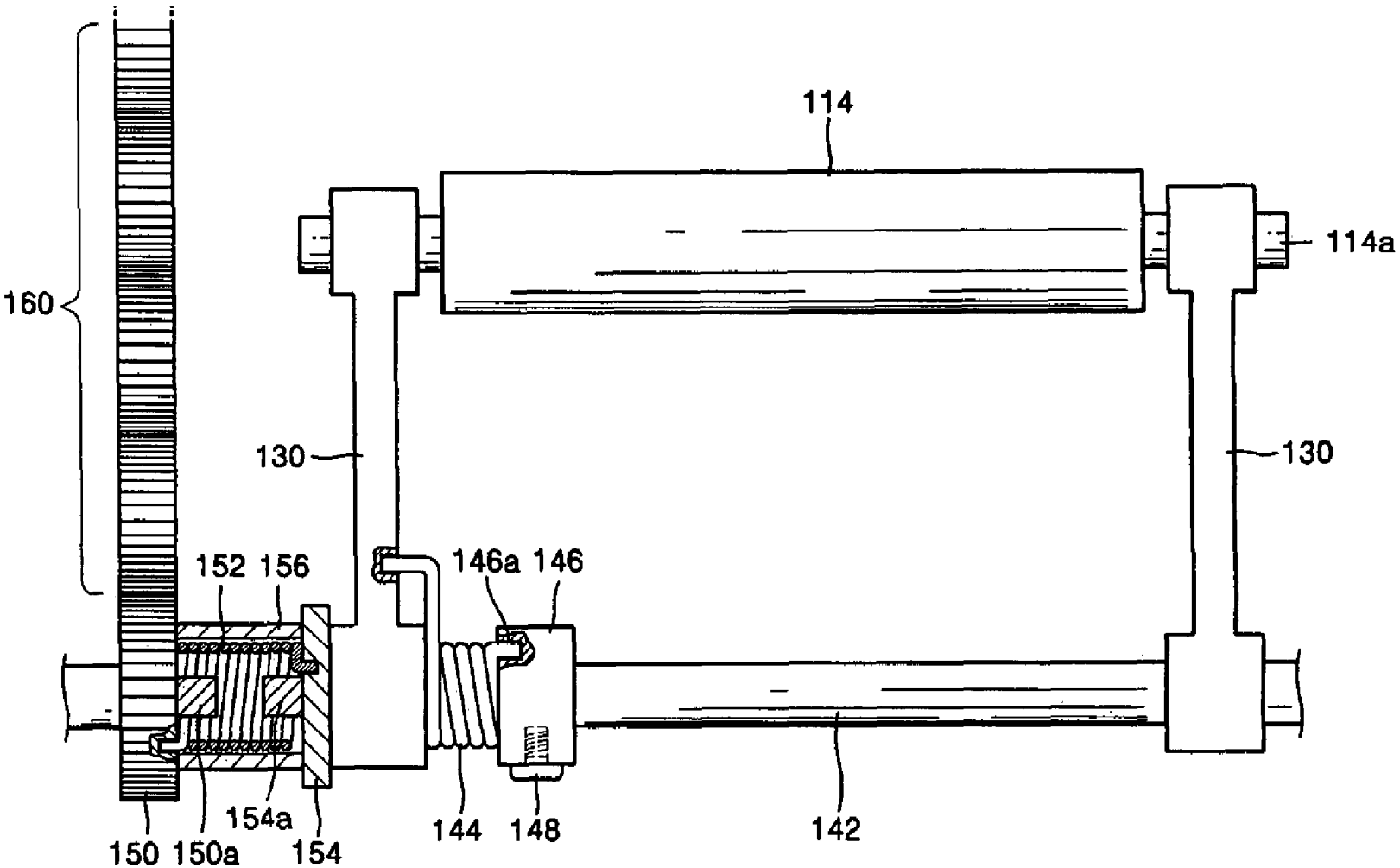
FIG. 4 is a schematic view of the tension adjuster of the belt illustrated in FIG. 3.

FIG. 4 illustrates the tension adjuster of the photosensitive belt 110 illustrated in FIG. 3. Referring to FIG. 4, the swing arms 130 connect the shaft 114*a* of the tension roller 114 to the shaft 142. A slip ring 154, a friction clutch spring 152, and the shaft gear 150 are sequentially disposed on the shaft 142 on one side of the swing arm 130 adjacent to the gear trains 160. A tension release spring 144 and a boss 146 are sequentially disposed on the shaft 142 on the other side of the same swing arm 130 adjacent to the relay rears 160. The slip ring 154 and the friction clutch spring 152 constitute a friction clutch.

The shaft gear 150 is connected to the gear 111*a* of the driving roller 111 by a plurality of gear trains 160 and rotates in synchronization with the rotation of the gear 111*a* of the driving roller 111 in a direction B. The direction B is opposite to a direction in which the driving roller 111 rotates. One end of the friction clutch spring 152 is connected to the shaft gear 150. The other end of the friction clutch spring 152 is connected to the slip ring 154. Therefore, the torque generated by the gear 111*a* of the driving roller 111 compresses the friction clutch spring 152. A compressive force on the friction clutch spring 152 is converted into a frictional force between the slip ring 154 and the swing arm 130. The frictional force rotates the swing arms 130. The slip ring 154 is not fixed to the swing arm 130.

The shaft gear 150 and the slip ring 154 preferably have convex portions 150*a* and 154*a*, respectively, facing each other. The friction clutch spring 152 preferably encloses the convex portions 150*a* and 154*a*. In addition, a friction clutch ring 156 covers the friction clutch spring 152 and is preferably disposed between the shaft gear 150 and the slip ring 154. Moreover, the clutch ring 156 maintains a fixed distance therebetween.

The boss 146 is fixed to the shaft 142 by a fixing unit such as a screw 148; however, any suitable arrangements and constructions may be used. One end of the tension releasing spring 144 is coupled to a groove 146*a* formed in the boss 146. The other end of the tension releasing spring 144 is coupled to the swing arm 130 adjacent to the gear trains 160 in an elastically biased state. The tension releasing spring 144 is elastically biased in a direction that allows for the tension of the tension roller 114 to be released (the direction B in FIG. 3). Further, the torque transmitted from the friction clutch spring 152 to the swing arms 130 may be adjusted by the tension releasing spring 144. In other words, when torque applied in the direction A (FIG. 3) is constant, the torque may be relatively easily controlled by adjusting an elastic force of the tension releasing spring 144 applied in the direction B.

Figure 5:
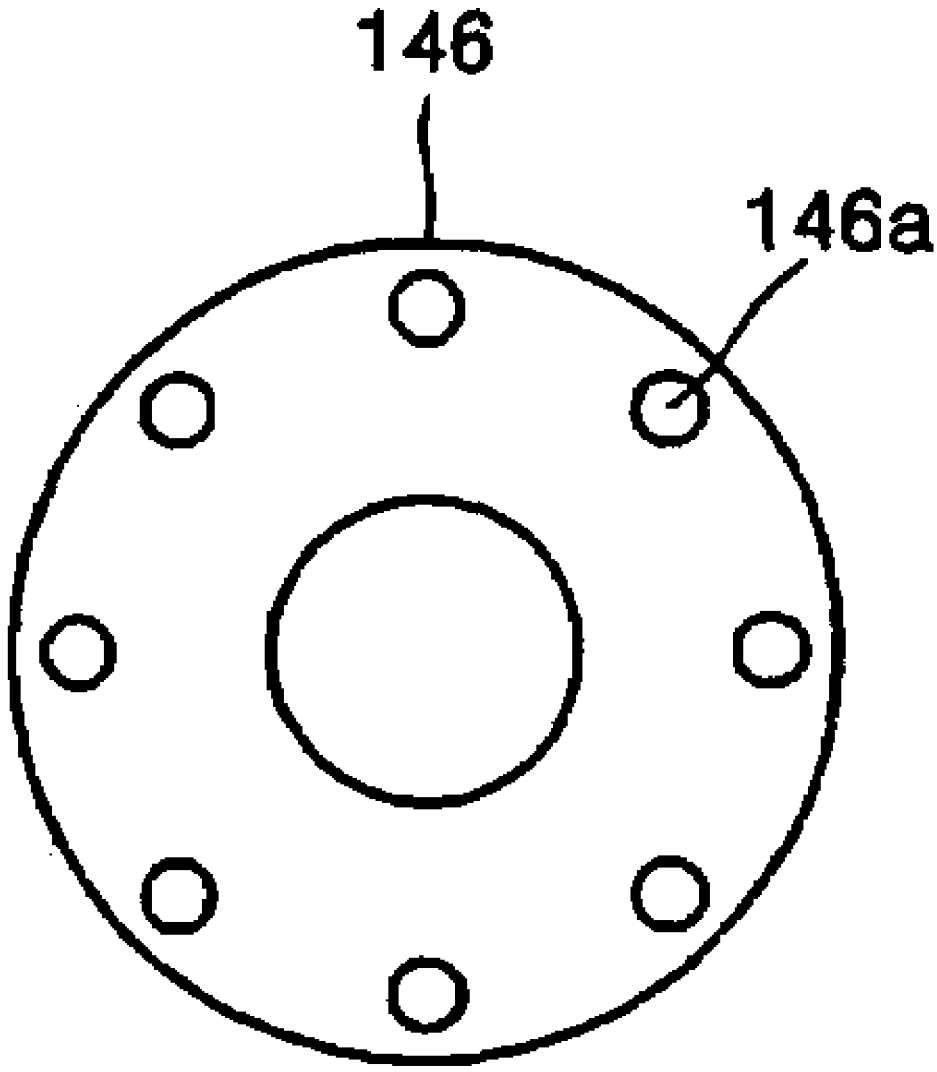
FIG. 5 is a side view of a boss facing a tension releasing spring.

FIG. 5 is a side view of the boss 146 facing the tension releasing spring 144. Referring to FIG. 5, the grooves 146*a* are formed in a concentric circle on a side of the boss 146 facing the tension releasing spring 144. The elastic force of the tension releasing spring 144 may be relatively easily adjusted by moving the end of the tension releasing spring 144 among the grooves 146*a* formed on the boss 146. In addition, the elastic force of the tension releasing spring 144 may be relatively easily adjusted by moving the boss 146 on the shaft 142 using the screw 148.

The operation of the tension adjuster of the photosensitive belt 110 will be described in detail with reference to the attached drawings. When the driving roller 111 rotates, the gear trains 160 and the shaft gear 150 connected to the gear 111*a* of the driving roller 111 also rotate. As the shaft gear 150 rotates at a constant speed, the friction clutch spring 152 becomes compressed, thereby pulling the slip ring 154 toward the swing arm 130. As a result, a frictional force is generated between the slip ring 154 and the swing arm 130. The frictional force produces a torque that rotates the swing arms 130 in the direction A. Since the torque is greater than the elastic force produced by the tension releasing spring 144 in the direction B, the swing arms 130 rotate in the direction A.

When the tensile force of the photosensitive belt 110 changes after the photosensitive belt 110 has been used for a relatively long period of time, the tension in the tension releasing spring 144 is controlled to adjust the tensile force of the photosensitive belt 110. In other words, the position of the end of the tension releasing spring 144 connected to the groove 146*a* of the boss 146 is changed. Alternatively, the position of the boss 146 on the shaft 142 is adjusted using the screw 148.

When the driving roller 111 stops, the torque transmitted to the swing arms 130 is removed, and the swing arms 130 are rotated away from the photosensitive belt 110 by the elastic force produced by the tension releasing spring 144. Thus, the photosensitive belt 110 is released. Therefore, even if the driving roller 111 stops for a relatively long period of time, the deformation of the photosensitive belt 110 may be prevented.

In the present embodiment, the gear trains 160 are used to rotate the shaft gear 150. However, other suitable arrangements, such as a motor, may be used to rotate the shaft 142.

As described above, a tension adjuster of a photosensitive belt in accordance with an embodiment of the present invention may produce an appropriate tension on the photosensitive belt by using a friction clutch. A tensile force of the photosensitive belt is relatively easily controlled by using a tension releasing spring. In addition, the deformation of the photosensitive belt may be prevented by releasing the photosensitive belt while a printer is not used.

While the present invention has been shown and described with reference to exemplary embodiments thereof, it will be understood by those of ordinary skill in the art that various changes in form and details may be made therein without departing from the spirit and scope of the present invention as defined by the appended claims.

What is claimed is:

1. A tension adjuster of a belt, the tension adjuster comprising:

a tension roller configured to rotatably contact an inner surface of the belt;

a fixed shaft being disposed a predetermined distance away from the tension roller;

a fixed shaft gear located on the circumference of the fixed shaft;

a plurality of gear trains interposed between a gear driving the belt and the fixed shaft gear to rotate the fixed shaft gear;

a pair of swing arms connecting the fixed shaft to a shaft of the tension roller;

a tension unit configured to rotate the swing arm on a circumference of the fixed shaft in a first direction so that the tension roller produces a tension on the belt, the tension unit comprising a friction clutch disposed on the circumference of the fixed shaft on an outward side of the swing arm, the fixed shaft gear being located on the circumference of the fixed shaft so that the friction clutch is disposed between the fixed shaft gear and the swing arm; and a tension releasing unit to apply torque to the swing arm on the circumference of the fixed shaft in a second direction opposite to the first direction, wherein, when the belt rotates, torque generated by the tension unit is greater than the torque generated by the tension releasing unit, so that when the belt is stopped, the belt is released by the torque of the tension releasing unit.

2. The tension adjuster of claim 1, wherein the friction clutch comprises a friction clutch spring interposed between the fixed shaft gear and the swing arm.

3. The tension adjuster of claim 2, further comprising a slip ring which is disposed between the friction clutch spring and the swing arm, the slip ring being coupled to one end of the friction clutch spring and being separated from the swing arm to transmit a frictional force from the friction clutch spring to the swing arm.

4. The tension adjuster of claim 1, wherein the plurality of gear trains interposed between a gear driving the belt and the fixed shaft gear form a rotating unit.

5. A tension adjuster of a belt, the tension adjuster comprising:

a tension roller configured to rotatably contact an inner surface of the belt;

a fixed shaft being disposed a predetermined distance away from the tension roller;

a pair of swing arms connecting the fixed shaft to a shaft of the tension roller;

a tension unit configured to rotate the swing arm on a circumference of the fixed shaft in a first direction so that the tension roller produces a tension on the belt, the tension unit comprising:

a friction clutch disposed on the circumference of the fixed shaft on an outward side of the swing arm;

a fixed shaft gear located on the circumference of the fixed shaft so that the friction clutch is disposed between the fixed shaft gear and the swing arm; and a rotating unit to rotate the fixed shaft gear, the rotating unit comprising a motor for driving the fixed shaft gear; and a tension releasing unit to apply torque to the swing arm on the circumference of the fixed shaft in a second direction opposite to the first direction, wherein, when the belt rotates, torque generated by the tension unit is greater than the torque generated by the tension releasing unit, so that when the belt is stopped, the belt is released by the torque of the tension releasing unit.

6. A tension adjuster of a belt, the tension adjuster comprising:

a tension roller configured to rotatably contact an inner surface of the belt;

a fixed shaft being disposed a predetermined distance away from the tension roller;

a fixed shaft gear located on the circumference of the fixed shaft;

a plurality of gear trains interposed between a gear driving the belt and the fixed shaft gear to rotate the fixed shaft gear;

a pair of swing arms connecting the fixed shaft to a shaft of the tension roller;

a tension unit configured to rotate the swing arm on a circumference of the fixed shaft in a first direction so that the tension roller produces a tension on the belt;

a tension releasing unit to apply torque to the swing arm on the circumference of the fixed shaft in a second direction opposite to the first direction;

a tension releasing spring disposed on an opposite side to the tension unit with respect to the swing arm, the tension releasing spring being located on the circumference of the fixed shaft and being configured to elastically bias in the second direction; and a boss fixed to the fixed shaft, the boss being disposed on the circumference of the fixed shaft opposite to the swing arm with respect to the tension releasing spring, wherein, when the belt rotates, torque generated by the tension unit is greater than the torque generated by the tension releasing unit, so that when the belt is stopped, the belt is released by the torque of the tension releasing unit.

7. The tension adjuster of claim 6, wherein a plurality of grooves are formed in a concentric circle on a side of the boss facing the tension releasing spring, and a tensile force of the tension releasing spring can be adjusted by coupling one end of the tension releasing spring to the groove.

8. The tension adjuster of claim 6, wherein the tensile force of the tension releasing spring is adjusted according to where the boss is coupled to the fixed shaft.

9. The tension adjuster of claim 1, wherein the belt is a photosensitive belt.

* * * * *